US009565890B2

(12) United States Patent
Walsh

(10) Patent No.: US 9,565,890 B2
(45) Date of Patent: Feb. 14, 2017

(54) RETAINING DEVICE AND SPIKE DEVICES FOR SHOES

(76) Inventor: Brendan Walsh, Hoboken, NJ (US)

( * ) Notice: Subject to any disclaimer, the term of this patent is extended or adjusted under 35 U.S.C. 154(b) by 1577 days.

(21) Appl. No.: 12/981,413

(22) Filed: Dec. 29, 2010

(65) Prior Publication Data

US 2011/0154690 A1 Jun. 30, 2011

Related U.S. Application Data

(60) Provisional application No. 61/290,985, filed on Dec. 30, 2009.

(51) Int. Cl.

| | |
|---|---|
| ***A43B 5/00*** | (2006.01) |
| ***A43B 15/00*** | (2006.01) |
| ***A43B 3/12*** | (2006.01) |
| ***A43B 1/10*** | (2006.01) |
| ***A43B 3/16*** | (2006.01) |
| ***A43B 3/02*** | (2006.01) |
| ***A43B 5/18*** | (2006.01) |

(52) U.S. Cl.
CPC *A43B 5/001* (2013.01); *A43B 5/18* (2013.01)

(58) Field of Classification Search
CPC ..... A43B 5/001; A43B 5/18
USPC .. 36/134, 7.1 R, 7.3, 7.5, 7.6, 114, 127, 135
See application file for complete search history.

(56) References Cited

U.S. PATENT DOCUMENTS

| | | | | |
|---|---|---|---|---|
| 1,154,890 | A | 9/1915 | Sauer, Jr. | 36/64 |
| 1,728,469 | A | 9/1929 | Bianco et al. | 36/64 |
| 1,749,522 | A | 3/1930 | Wedig | 36/7.7 |
| 1,902,521 | A | 3/1933 | Rice | 36/7.7 |
| 2,006,802 | A | 7/1935 | Goodman | 36/7.7 |
| 2,260,138 | A | 10/1941 | Feinberg | 36/1 |
| 3,075,307 | A | 1/1963 | Becker | 36/7.7 |
| 3,176,416 | A | 4/1965 | Seegert | 36/7.1 |
| 3,731,406 | A | 5/1973 | Young | 36/67 |
| 3,755,929 | A | 9/1973 | Frisch | 36/7.6 |
| 3,822,489 | A | 7/1974 | Johnson | 36/2.5 |
| 3,827,166 | A | 8/1974 | Goodman | 36/2.5 |
| 3,866,339 | A | 2/1975 | Latto | 36/7.6 |
| 3,977,097 | A | 8/1976 | Ueda | 36/67 |
| 4,004,356 | A | 1/1977 | Green | 36/134 |
| 4,010,558 | A | 3/1977 | Slusher | 36/7.3 |
| 4,026,047 | A | 5/1977 | Ahmer | 36/136 |
| 4,063,372 | A | 12/1977 | MacNeill | 36/127 |
| 4,114,295 | A | 9/1978 | Schaeffer | 36/100 |
| 4,156,316 | A | 5/1979 | DeFever | 36/132 |
| 4,178,702 | A | 12/1979 | Mayer | 36/59 |
| 4,221,029 | A | 9/1980 | Jerome | 24/265 |
| 4,333,249 | A | 6/1982 | Schaeffer | 36/115 |
| 4,408,403 | A | 10/1983 | Martin | 36/115 |
| 4,445,289 | A | 5/1984 | Beneteau | 36/134 |

(Continued)

*Primary Examiner* — Anna Kinsaul
*Assistant Examiner* — Cameron A Carter
(74) *Attorney, Agent, or Firm* — Walter J. Tencza, Jr.

(57) ABSTRACT

An apparatus including a retaining device and a plurality of flexible memory spike devices for golf. The retaining device may be adapted to be temporarily attached to a shoe. The retaining device may be adapted so that the plurality of spike devices can be attached or detached from the retaining device. The retaining device may be made of an elastomeric material. The retaining device may have a plurality of openings, and each of the plurality of spike devices can be at least partially inserted into a corresponding one of the plurality of openings to attach each of the plurality of spike devices to the retaining device.

20 Claims, 5 Drawing Sheets

(56) References Cited

U.S. PATENT DOCUMENTS

| | | | | | |
|---|---|---|---|---|---|
| 4,454,664 | A | | 6/1984 | MacNeil | 36/127 |
| 4,667,422 | A | | 5/1987 | Yamaguchi | 36/67 |
| 4,706,394 | A | | 11/1987 | Regula | 36/67 |
| 4,723,366 | A | | 2/1988 | Hagger | 36/134 |
| 4,783,913 | A | | 11/1988 | Aoyama | 36/134 |
| 4,811,502 | A | | 3/1989 | Barret | 36/115 |
| 4,872,273 | A | | 10/1989 | Smeed | 36/135 |
| 4,875,300 | A | | 10/1989 | Kazz | 36/134 |
| 4,936,028 | A | | 6/1990 | Posacki | 36/15 |
| 5,070,631 | A | | 12/1991 | Fenton | 36/127 |
| 5,167,084 | A | | 12/1992 | Flammier | 36/117.2 |
| 5,172,496 | A | | 12/1992 | Vemi | 36/135 |
| 5,289,647 | A | | 3/1994 | Mercer | 36/134 |
| 5,299,369 | A | | 4/1994 | Goldman | 36/61 |
| 5,301,442 | A | | 4/1994 | Williams | 36/127 |
| 5,317,822 | A | | 6/1994 | Johnson | 36/101 |
| 5,319,869 | A | | 6/1994 | McDonald | 36/114 |
| 5,379,530 | A | | 1/1995 | Bell | 36/89 |
| 5,410,823 | A | | 5/1995 | Iyoob | 36/127 |
| 5,433,436 | A | * | 7/1995 | Hoyt et al. | 473/406 |
| 5,497,565 | A | | 3/1996 | Balgin | 36/61 |
| 5,513,451 | A | | 5/1996 | Kataoka | 36/129 |
| 5,548,910 | A | | 8/1996 | Klingseis | 36/135 |
| 5,600,901 | A | | 2/1997 | Leonor | 36/7.1 |
| 5,661,915 | A | | 9/1997 | Smith | 36/15 |
| 5,666,746 | A | | 9/1997 | Pollard | 36/135 |
| 5,727,340 | A | | 3/1998 | Suk | 36/134 |
| 5,732,484 | A | | 3/1998 | Grutza | 36/127 |
| 5,791,071 | A | | 8/1998 | Rosdail | 36/134 |
| 5,794,368 | A | | 8/1998 | Kirby | 36/135 |
| 5,836,092 | A | | 11/1998 | Yarnell | 36/61 |
| 5,848,484 | A | | 12/1998 | Dupree | 36/101 |
| 5,901,472 | A | | 5/1999 | Adam | 36/134 |
| 5,921,005 | A | * | 7/1999 | Bell | A43C 15/02 36/11.5 |
| 5,926,980 | A | | 7/1999 | Adam | 36/134 |
| 5,950,333 | A | | 9/1999 | Tsen | 36/7.1 |
| 5,964,048 | A | | 10/1999 | Shieh | 36/135 |
| 6,006,454 | A | | 12/1999 | Sitzler | 36/127 |
| 6,032,386 | A | | 3/2000 | Evans | 36/15 |
| 6,079,127 | A | | 6/2000 | Nishimura | 36/61 |
| 6,105,282 | A | | 8/2000 | Wiand | 36/134 |
| 6,151,805 | A | * | 11/2000 | Savoie | A43C 15/161 36/114 |
| 6,154,982 | A | * | 12/2000 | Bell | A43B 5/18 36/7.3 |
| 6,154,984 | A | | 12/2000 | Adam | 36/134 |
| 6,170,364 | B1 | | 1/2001 | Johnson | 81/176.1 |
| 6,253,468 | B1 | | 7/2001 | Hirota | 36/134 |
| 6,260,292 | B1 | | 7/2001 | Swedick | 36/134 |
| 6,321,467 | B1 | | 11/2001 | Tsen | 36/97 |
| 6,338,208 | B1 | | 1/2002 | Waterbury | 36/134 |
| 6,352,319 | B1 | | 3/2002 | Grant | 305/160 |
| 6,474,000 | B2 | | 11/2002 | Burt | 36/50.1 |
| 6,502,332 | B1 | | 1/2003 | Nakayama | 36/134 |
| 6,519,879 | B2 | | 2/2003 | Gee | 36/134 |
| 6,543,063 | B2 | * | 4/2003 | Greer | 2/239 |
| 6,568,101 | B1 | | 5/2003 | Janson | 36/7.3 |
| 6,578,746 | B1 | * | 6/2003 | Greves | 473/406 |
| 6,601,322 | B2 | | 8/2003 | Hsiao | 36/134 |
| 6,675,505 | B2 | | 1/2004 | Terashima | 36/134 |
| 6,813,847 | B2 | | 11/2004 | Workman | 36/15 |
| 6,898,872 | B2 | | 5/2005 | McKissic | 36/100 |
| 6,988,328 | B2 | | 1/2006 | Rosen | 36/7.1 |
| 7,007,413 | B2 | | 3/2006 | McMullin | 36/134 |
| 7,065,906 | B2 | | 6/2006 | Jones | 36/50.1 |
| 7,073,280 | B2 | | 7/2006 | Terashima | 36/127 |
| 7,073,281 | B2 | | 7/2006 | Terashima | 36/134 |
| 7,086,182 | B2 | * | 8/2006 | Deacon | A43C 15/162 36/127 |
| 7,134,226 | B2 | | 11/2006 | Robinson | 36/134 |
| 7,331,123 | B2 | | 2/2008 | Workman | 36/15 |
| RE40,460 | E | | 8/2008 | Savoie | 36/134 |
| 7,409,782 | B2 | * | 8/2008 | Larson | A43B 3/16 36/59 R |
| 7,520,069 | B2 | | 4/2009 | Workman | 36/15 |
| 7,584,553 | B1 | * | 9/2009 | Medley | A43B 5/001 36/11.5 |
| 7,591,084 | B2 | | 9/2009 | Santa Ana | 36/100 |
| 2001/0047597 | A1 | | 12/2001 | Smith | 36/127 |
| 2001/0047599 | A1 | | 12/2001 | Heller | 36/134 |
| 2002/0144438 | A1 | | 10/2002 | Better | 36/127 |
| 2002/0152643 | A1 | | 10/2002 | Kim | 36/127 |
| 2003/0088996 | A1 | * | 5/2003 | Hall | A43B 3/0078 36/2 R |
| 2003/0093926 | A1 | * | 5/2003 | Auger | A43C 15/161 36/134 |
| 2003/0154626 | A1 | * | 8/2003 | Larson | A43B 3/16 36/7.6 |
| 2003/0172551 | A1 | | 9/2003 | Lee | 36/61 |
| 2004/0035024 | A1 | | 2/2004 | Kao | 36/7.1 |
| 2004/0035026 | A1 | | 2/2004 | Foster | 36/135 |
| 2004/0045190 | A1 | * | 3/2004 | Washburn | A43C 15/162 36/7.6 |
| 2004/0068890 | A1 | | 4/2004 | Palahnuk | 36/7.1 |
| 2004/0187356 | A1 | | 9/2004 | Patton | 36/134 |
| 2004/0254034 | A1 | * | 12/2004 | Tymchyn | A43B 5/001 473/406 |
| 2005/0160631 | A1 | | 7/2005 | Love | 36/135 |
| 2005/0198860 | A1 | * | 9/2005 | Larson | A43B 3/16 36/7.6 |
| 2006/0000118 | A1 | | 1/2006 | Kim | 36/134 |
| 2006/0080861 | A1 | * | 4/2006 | Park | A43B 3/16 36/7.6 |
| 2007/0056190 | A1 | | 3/2007 | Seals | 36/114 |
| 2007/0227045 | A1 | | 10/2007 | Aveni | 36/54 |
| 2007/0277399 | A1 | | 12/2007 | Dow | 36/134 |
| 2008/0000102 | A1 | * | 1/2008 | Rastegar | A43B 1/0027 36/7.6 |
| 2008/0016722 | A1 | | 1/2008 | Battagliano | 36/114 |
| 2008/0072460 | A1 | * | 3/2008 | Robinson | A43B 5/001 36/134 |
| 2008/0301973 | A1 | * | 12/2008 | Lee Tsai | A43C 15/061 36/7.1 R |
| 2009/0056169 | A1 | * | 3/2009 | Robinson, Jr. | A43B 5/001 36/102 |
| 2009/0249648 | A1 | * | 10/2009 | Brown | A43B 5/001 36/91 |
| 2009/0249653 | A1 | * | 10/2009 | Gunthel | A43B 3/0094 36/127 |
| 2009/0307933 | A1 | * | 12/2009 | Leach | A43C 15/161 36/134 |
| 2010/0139118 | A1 | * | 6/2010 | Park | A43B 5/001 36/7.6 |

* cited by examiner

RETAINING DEVICE AND SPIKE DEVICES FOR SHOES

CROSS REFERENCE TO RELATED APPLICATION(S)

The present application claims the priority of U.S. provisional patent application Ser. No. 61/290,985, titled "TEMPORARY ATHLETIC SPIKE FOR SNEAKERS", filed on Dec. 30, 2009, inventor and applicant Brendan Walsh.

FIELD OF THE INVENTION

This invention relates to improved methods and apparatus concerning athletic equipment and athletic footwear, particularly athletic footwear related to golf.

BACKGROUND OF THE INVENTION

There are various devices known in the art for athletic footwear.

SUMMARY OF THE INVENTION

In at least one embodiment of the present invention, an apparatus is provided comprising a retaining device, and a plurality of spike devices. The retaining device may be adapted to be temporarily attached to a shoe. The retaining device may be adapted so that the plurality of spike devices can be attached or detached from the retaining device, while the retaining device is temporarily attached to the shoe. The retaining device may be made of an elastomeric material.

The retaining device may have a plurality of openings, and wherein each of the plurality of spike devices can be at least partially inserted into a corresponding one of the plurality of openings to attach each of the plurality of spike devices to the retaining device. Each of the plurality of spike devices may have a flat side which can be fully inserted into a chamber of the retaining device in order to attach each of the plurality of spike devices to the retaining device. Each of the plurality of spike devices may have a plurality of protrusions, prongs, or spikes which project out away from the flat side. Each of the plurality of spike devices may be made of an elastomer/kevlar blend. Each of the plurality of protrusions, prongs, or spikes of each of the plurality of spike devices may be flexible and may have memory so that after being flexed, each of the plurality of protrusions, prongs, or spikes, flexes back or returns to its original position and state.

The retaining device is adapted so that it can be temporarily attached to a shoe so that there is a first portion of the retaining device which lies beneath a heel of the shoe, and a second portion which lies beneath a front portion of the shoe. The retaining device may also be adapted or configured so that it can be attached to a shoe so that a portion of the retaining device is on the front of the shoe and a portion of the retaining device is on the rear of the shoe.

The retaining device may be adapted so that at least one of the plurality of spike devices can be attached to the first portion of the retaining device while simultaneously at least one of the plurality of spike devices is attached to the front portion of the retaining device of the shoe. The first portion may have at least one opening into which at least one of the plurality of spike devices can be at least partially inserted to attach at least one of the plurality of spike devices to the retaining device. The second portion may have at least one opening into which at least one of the plurality of spike devices can be at least partially inserted to attach at least one of the plurality of spike devices to the retaining device.

The retaining device may have a first plurality of cavities and a second plurality of cavities. Each of the first plurality of cavities may lead to a corresponding one of the second plurality of cavities. Each of the first plurality of cavities may be smaller than its corresponding one of the second plurality of cavities. A first portion of each of the spike devices may need to be compressed to fit through at least one of the first plurality of cavities, and wherein the first portion of each of the spike devices expands after fitting through at least one of the first plurality of cavities to fit into a corresponding one cavity of the second plurality of cavities.

Each of the spike devices may include a second portion attached to the first portion, and wherein the second portion of each of the spike devices fits into at least one of the first plurality of cavities without being compressed.

At least one embodiment of the present invention may include a method comprising attaching a retaining device to a shoe, attaching a plurality of spike devices to the retaining device, detaching the retaining device from the shoe, and wherein the retaining device is adapted so that the plurality of spike devices can be attached or detached from the retaining device, while the retaining device is temporarily attached to the shoe.

In at least one embodiment of the present invention, the retaining device also includes a holding device for holding a golf ball marker, typically in a rear section of the retaining device. Having a holding device for holding a golf ball marker located in this manner allows a golfer to easily retrieve a golf ball marker and to thus mark their golf ball with ease.

DETAILED DESCRIPTION OF THE DRAWINGS

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
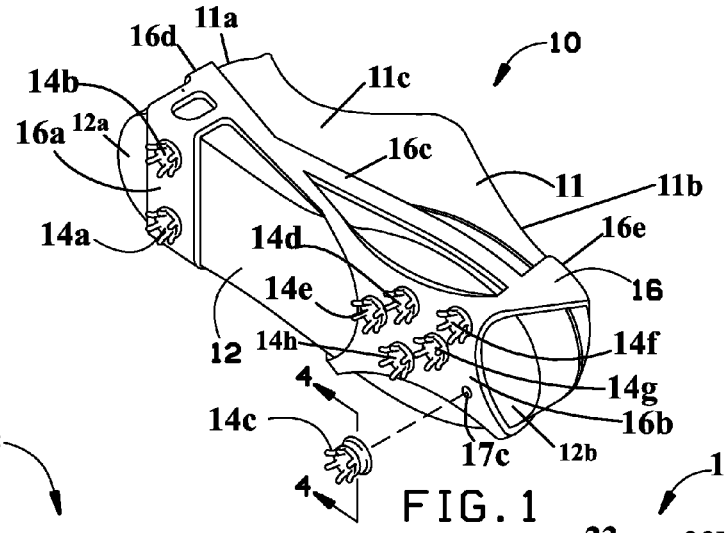
FIG. 1 is a bottom perspective view of an apparatus which includes a shoe, a retaining device, and a plurality of spike devices, with a first spike device detached from the retaining device in accordance with an embodiment of the present invention.

FIG. 1 is a bottom perspective view of an apparatus 10 in accordance with at least one embodiment of the present invention, including a shoe 11, A retaining device 16, and a plurality of spike devices 14*a*, 14*b*, 14*c*, 14*d*, 14*e*, 14*f*, 14*g*, and 14*h*. A first spike device, such as spike device 14*c* is shown detached from the retaining device 16 in FIG. 1.

The shoe 11 can be any shoe, such as a sneaker, tennis shoe or other shoe. The shoe 11 may have a sole 12 having a heel or bottom rear portion 12*a* and a toe or top front portion 12*b*. The shoe 11 may also have sides 11*c*, a back portion 11*a*, and a front portion 11*b*. The retaining device 16 may include a rear portion 16*a* fits and/or lies under heel or bottom rear portion 12*a* and a front portion 16*b* which fits and/or lies under toe or top front portion 12*b*. The retaining device 16 may also include a rear portion 16*d* which fits and/or lies behind shoe back portion 11*a*, and a toe portion 16*e* which fits and/or lies on top of shoe front portion 11*b*. The retaining device 16 may be made of an elastomer, a flexible rubber, or a hybrid of an elastomer and a flexible rubber. The retaining device 16 may be made of TPE (thermoplastic elastomer).

Figure 2:
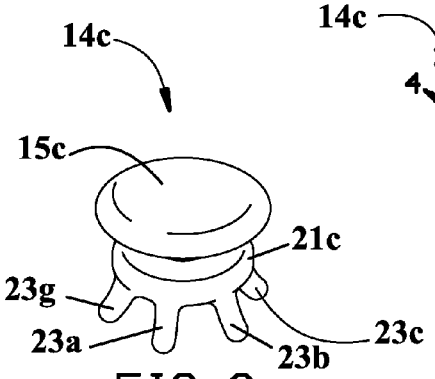
FIG. 2 is a top perspective view of the first spike device of FIG. 1.
Figure 3:
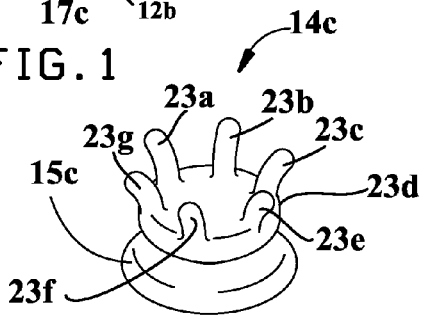
FIG. 3 is bottom perspective view of the first spike device of FIG. 1.
Figure 4:
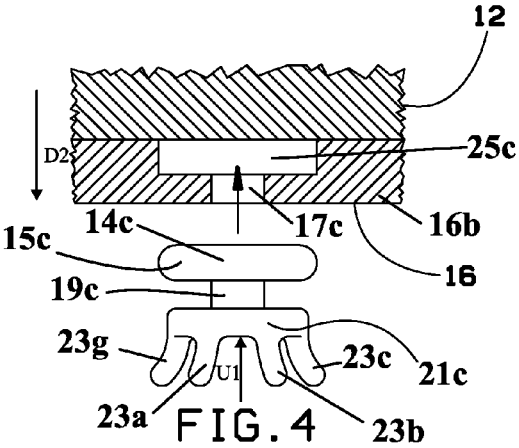
FIG. 4 is a section view of a portion of the shoe, the retaining device and the first spike device of FIG. 1 taken along line 4-4 in FIG. 1, with the first spike device detached from the retaining device.
Figure 5:
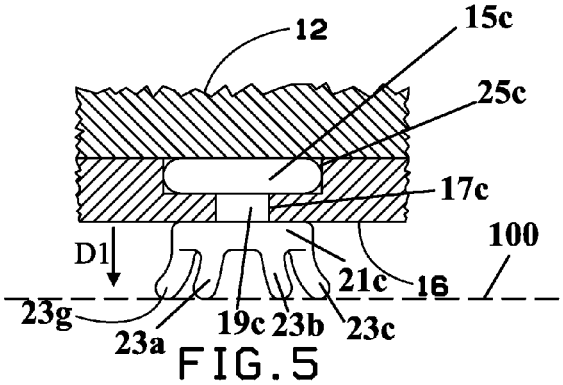
FIG. 5 is a section view of a portion of the shoe, the retaining device and the first spike device of FIG. 1 taken along line 4-4 in FIG. 1, with the first spike device inserted into the retaining device.

FIGS. 2 and 3 show top and bottom perspective views of the first spike device 14*c* of FIG. 1. FIG. 4 is a section view of a portion a sole 12 of the shoe 11, the retaining device 16 and the first spike device 14*c* of FIG. 1 taken along line 4-4 in FIG. 1, with the first spike device 14*c* detached from the retaining device 16. FIG. 5 is a section view of a portion of the sole 12 of the shoe 11, the retaining device 16 and the first spike device 14*c* of FIG. 1 taken along line 4-4 in FIG. 1, with the first spike device 14*c* inserted into the retaining device 16.

The spike device 14*c* may have a top portion 15*c*, a middle portion 19*c*, a base portion 21*c*, and prongs or spikes 23*a*, 23*b*, 23*c*, 23*d*, and 23*e* as shown by FIGS. 2-5. Each of the spike devices 14*a-b* and 14*d-h* may be identical to the spike device 14*c*.

The retaining device 16 may have an opening 17*c* leading to a chamber 25*c* as shown in FIG. 4. The top portion 15*c* of the spike device 14*c* can be inserted into the chamber 25*c* and simultaneously the middle portion 19*c* of the spike device 14*c* can be inserted into the opening 17*c* as shown in FIG. 5. The retaining device 16 may have a plurality of further openings and chambers, similar to or identical to the opening 17*c* and the chamber 25*c* for each of spike devices 14*a-b* and 14*d-h*.

Portion 15*c*, 19*c*, 21*c*, and prongs 23*a-g* of the spike device 14*c* may be made of polyurethane or similar material which can connect to an elastomeric retainer. The retaining device 16 may be made of an elastomeric material.

In at least one embodiment, the retainer or retaining device 16 stretches over the shoe 11, such as a over a sneaker, to turn it into a golf shoe or other athletic shoe for a day. The retaining device 16 and has cavities, openings, or chambers, such as opening 17*c* leading to cavity 25*c* for spike device 14*c* and similar openings and cavities for other spike devices of spike devices 14-*b* and 14*d-h*.

The retaining device 16 and the spike devices 14*a*-14*h*, provides a golfer without golf shoes (such as golf shoes with spikes permanently fixed to the bottom of the golf shoes), the ability to stretch the elastomeric material, such as retaining device 16, over their sneakers, tennis shoes, etc., such as shoe 11, and thereby temporarily attach spikes devices 14*a-h* to the shoe 11. The retaining device 16 and the spike devices 14*a-h* provide stability and gripping where there previously was none.

The spike device 14*c* can have various different types of shapes for protrusions, spikes or prongs 23*a-e*. The protrusions, spikes or prongs may have different types of edges, which may depend on sizing. The portion 15*c* of the spike device 14*c* shown in FIG. 4 is shaped to fit into the cavity or chamber 25*c* by, for example, pushing down in the direction D2 on the sole 12 shown in FIG. 4, while pushing up in the direction U1 on the spike device 14*c*, or by pushing down on the sole 12 in the direction D2, while holding the spike device 14*c* still or stationary, or by pushing up in the direction U1 on the spike device 14*c* while holding the sole 12 stationary or still. Any of these actions, with a sufficient pressure or force applied will cause the spike device 14*c* to lock into place, so that portion 15*c* is within chamber or cavity 25*c* and simultaneously portion 19*c* is within opening 17*c* as shown in FIG. 5 The force applied in the direction U1 on the spike device 14*c*, may be applied with a person's thumb, while the force applied in the direction D2 may be applied with a person's foot by simply pressing down on the sole 12 with a person's foot. The spike devices 14*a-b* and 14*d-h* may be inserted into openings and/or chambers in retaining device 16 in an identical or similar manner to the spike device 14*c*. When the spike device 14*c* is situated as in FIG. 5, bottom edges or surfaces of spikes, prongs or protrusions 23*a-f* can make contact with a ground surface 100 shown by a dashed line in FIG. 5 to grip the ground surface 100. Similarly, bottom edges or surfaces of spike devices 14*a-b* and 14*d-h* can also make contact with ground surface 100.

In embodiments, different spike patterns and placements can be adjusted. The fitting is standard but can be possibly changed with new technology. Embodiments could be made with plastics, etc.

In at least one embodiment, to place the spike devices 14*a-h* in the elastomeric material or retaining device 16 onto a sneaker, such as shoe 11, take the spikes (already placed in the cavities or openings, such as 17*c* and 25*c* and similar openings and cavities, in the elastomeric material or retaining device 16) and stretch the retaining device 16 over the shoe 11, to turn them the shoe 11 into a temporary golf shoe.

In at least one embodiment, the opening, cavity, or chamber 17*c* is smaller than the opening, cavity, or chamber 25*c* shown in FIG. 4. This configuration allows a spike device, such as spike device 14*c*, to be snapped or temporarily locked into the retaining device 16 as shown in FIG. 5. The opening, chamber, or cavity 17*c* may be circular and may have a diameter of about one quarter of an inch. The opening, chamber, or cavity 25*c* may be aligned and concentric with the opening, chamber or cavity 17*c* and may be circular and have a diameter of about one half of an inch. The portion 15*c* of the spike device 14*c* is typically elastic and can be compressed to fit it through the narrow opening 17*c* and into the larger chamber 25*c*. The spike device 14*c* may be made of kevlar, elastomer, or a kevlar/elastomer blend. The spike device 14*c* may only include kevlar, elastomer or a kevlar/elastomer blend or may be substantially comprised of these materials. The kevlar, elastomer, or kevlar/elastomer blend of materials may be resilient and may have memory of form, so that when it is flexed it, after removal of flexing forces, it returns to its original form. The spike devices, such as spike device 14*c*, for example, may be made of TPU (thermoplastic polyurethane).

The portion 15*c* of the spike device 14*c* may be circular and may have a diameter of about one half of an inch, which may be the same as or slightly less than the diameter of the chamber 25*c*. After the portion 15*c* has been inserted into the chamber 25*c* and the portion 19*c* has been inserted into the chamber 17*c* as shown in FIG. 5, then it is difficult to remove the spike device 14*c* from the retaining device 16. The spike device 14*c*, typically must be pulled out by hand, such as by pulling the prongs, spikes, or protrusions 23*a-g* in the direction D1 in FIG. 5, to detach the spike device 14*c* from the retaining device 16.

Embodiments may be specifically geared towards golf. Embodiments are also re-usable and you can purchase additional spike devices for spike devices 14*a-h*, as they wear down over time. It should be understood, of course, that the foregoing relates to exemplary embodiments of the invention and that modifications may be made without departing from the spirit and scope of the invention as set forth in the following claims.

Figure 6:
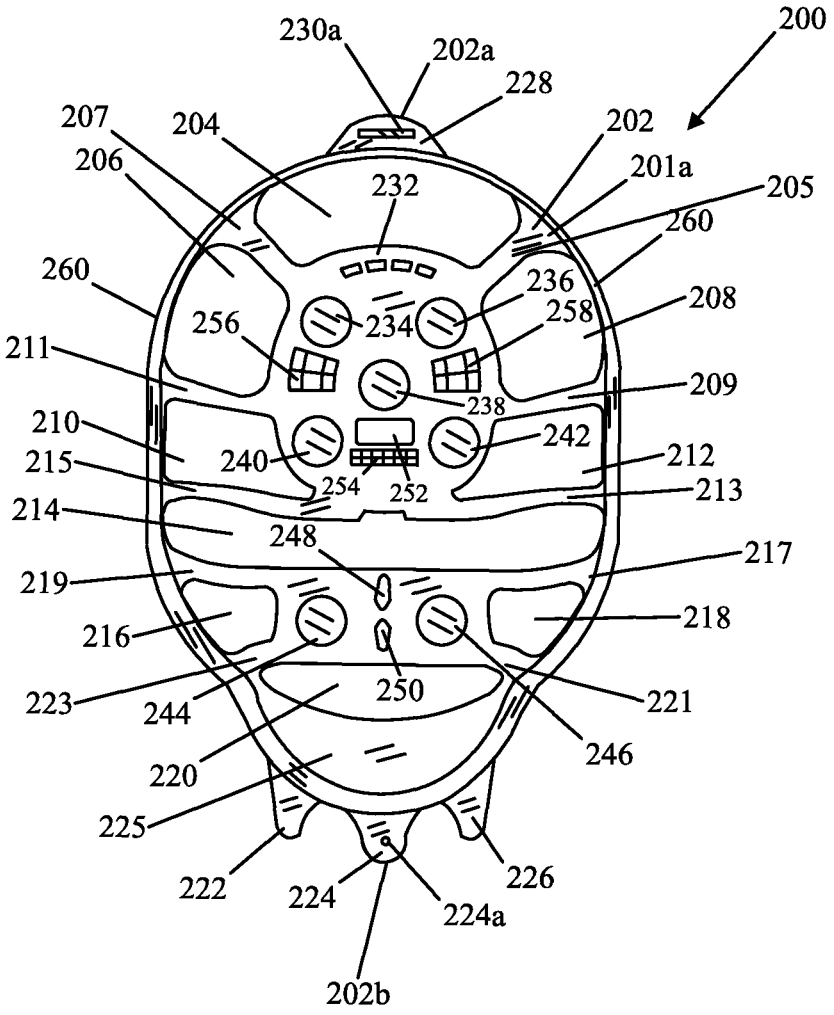
FIG. 6 is a top planar view of another apparatus in accordance with another embodiment of the present invention.
Figure 7:
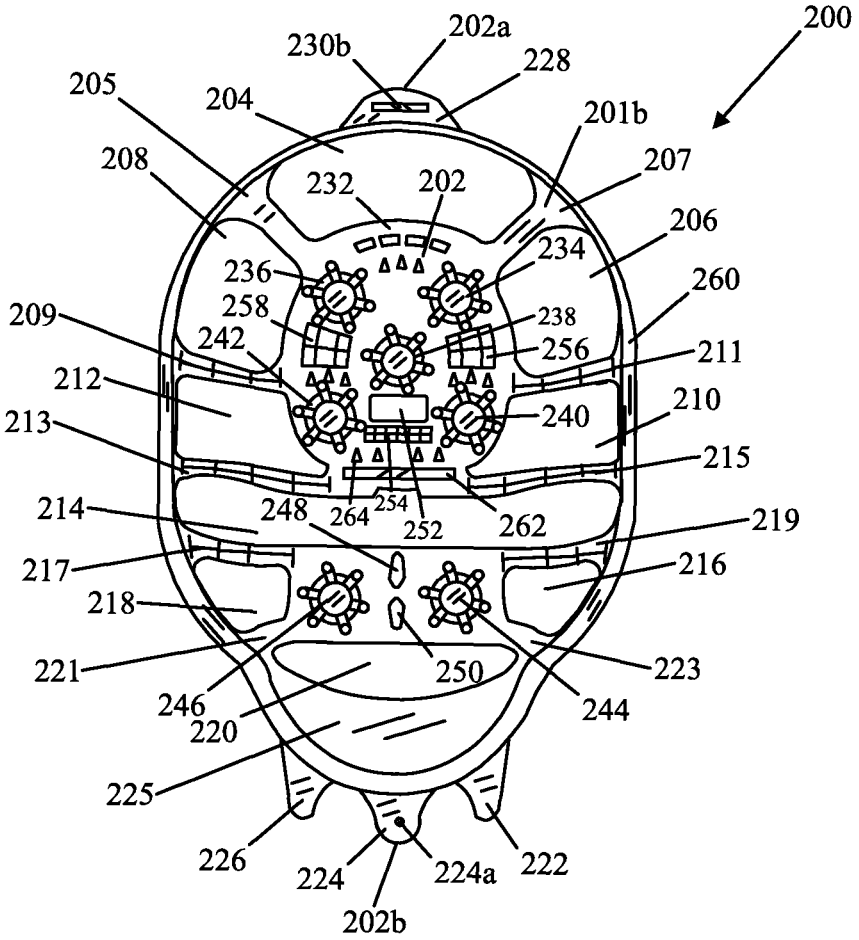
FIG. 7 is a bottom planar view of the apparatus of FIG. 6.

FIG. 6 is a top planar view of an apparatus 200 in accordance with another embodiment of the present invention. FIG. 7 is a bottom planar view of the apparatus 200 of FIG. 6. The apparatus 200 may be considered to be a retaining device in accordance with an embodiment of the present invention.

Referring to FIGS. 6 and 7, the apparatus 200 includes a body portion 202 which may be made of an elastomer, a flexible rubber, or a hybrid of an elastomer and a flexible rubber. The body portion 202 may have openings or holes 204, 206, 208, 210, 212, 214, 216, 218, and 220. The body portion 202 may also have a plurality of substantially square openings or holes 232, and grids 256, 258, and 254 of further openings or holes. The body portion 202 also has holes or openings 248 and 250.

The body portion 202 may also include extensions or sections 205, 207, 209, 211, 213, 215, 217, 219, 221, 223, and 225, each of which is connected at one end or edge to peripheral rim, ridge, or portion 260. The body portion 202 has a toe end 202*a* and a heel end 202*b*. Located at the toe end 202*a* is a pull tab 228 which has a ridge 230*a* shown in FIG. 6 on top 201*a* of the body portion 202 and a ridge 230*b* shown in FIG. 7 on the bottom 201*b* of the body portion 202. Located at the heel end 202*b* are tabs 222, 224, and 226. Tab 224 has a hole 224*a* into which a point of a ball marker 227, shown in FIG. 8, or a point of a tee 229, shown in FIG. 10, can be inserted to attach the ball marker 227 or the tee 229 to the tab 224 and thus to the apparatus 200.

The body portion 202 also has attached thereto spike devices or protrusion devices 234, 236, 238, 240, 242, 244, and 246. Each of spike devices 234, 236, 238, 240, 242, 244, and 246 may be similar to or identical to any one of spike devices 14*a-h* previously described with reference to FIGS. 1-5 of the present application. FIG. 6 shows the top of the spike devices 234-246 and FIG. 7 shows the prongs or protrusions of spike devices 234-236 which would contact a ground surface.

Figure 8:
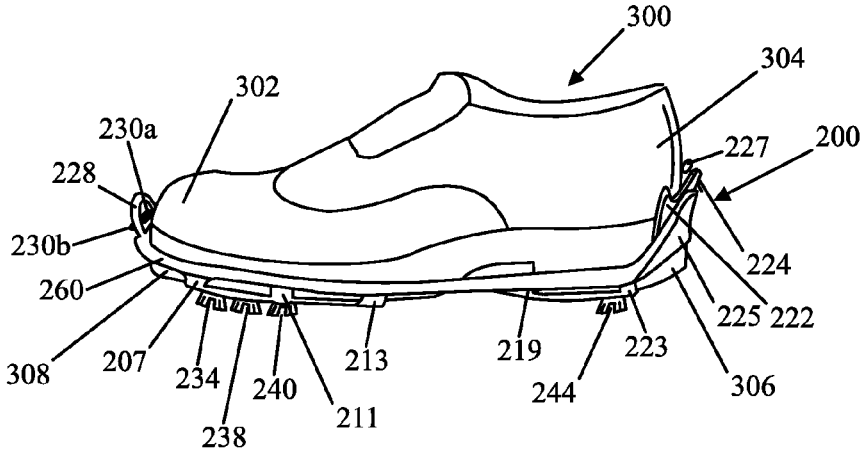
FIG. 8 is a side perspective view of the apparatus of FIGS. 6-7 placed on a shoe.
Figure 9:
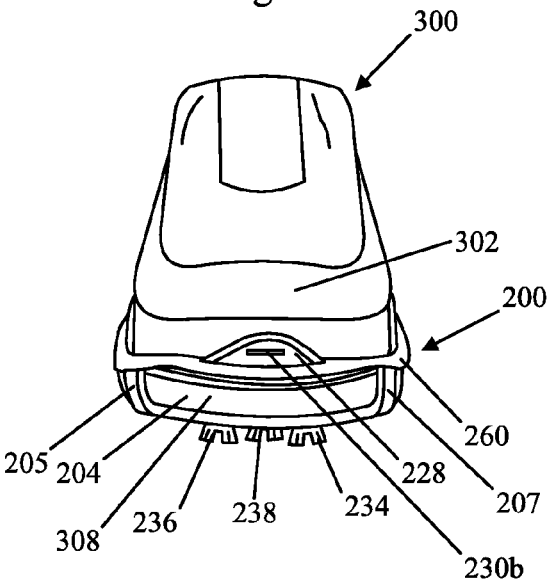
FIG. 9 is a front perspective view of the apparatus of FIGS. 6-7 placed on a shoe.
Figure 10:
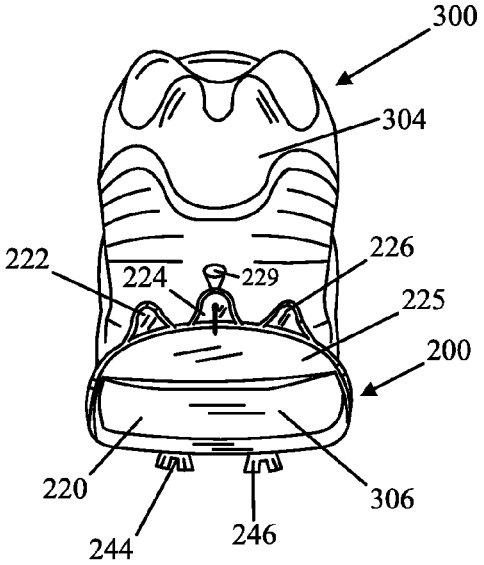
FIG. 10 is a rear perspective view of the apparatus of FIGS. 6-7 placed on a shoe.
Figure 11:
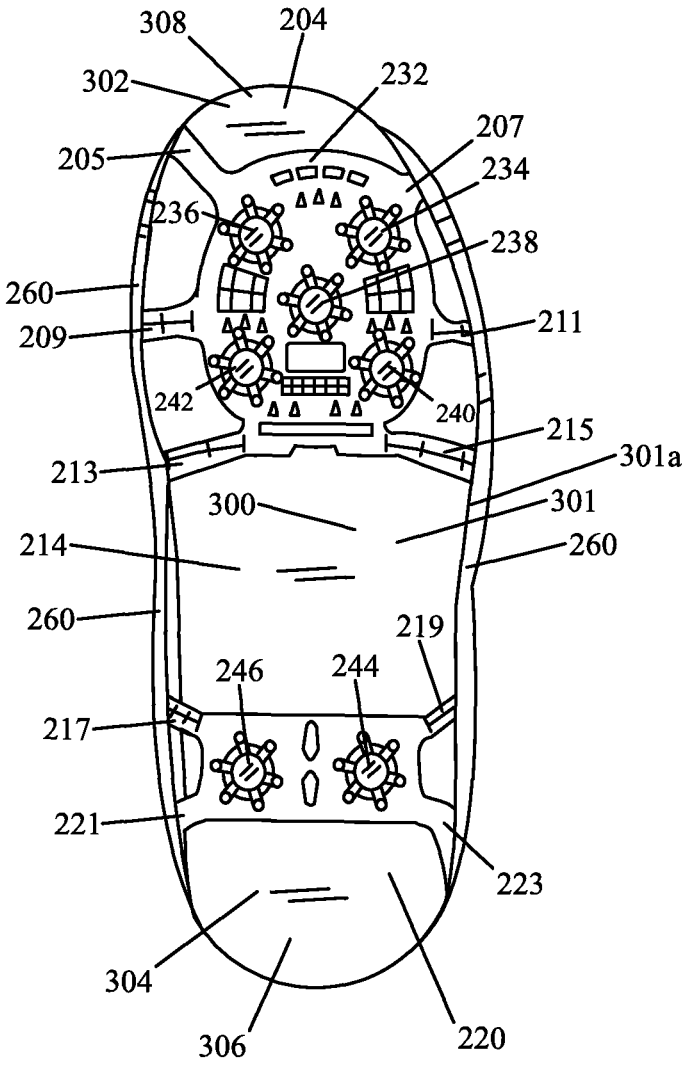
FIG. 11 is a bottom planar view of the apparatus of FIGS. 6-7 placed on a shoe.

FIGS. 8-10 show side, front, and rear perspective views of the apparatus 200 of FIGS. 6-7 placed on a shoe 300. FIG. 11 is a bottom planar view of the apparatus 200 of FIGS. 6-7 placed on the shoe 300.

In operation an individual grabs the tab 228 and/or the toe end 202*a* of the apparatus 200 with one hand and grabs one or more of the tabs 222, 224, and 226 and/or the heel end 202*b* with a second hand and pulls the tab 228 and/or toe end 202*a* in a first direction while simultaneously pulling the tabs 222, 224, and 226 and/or heel end 202*b* in a second direction, which is opposite the first direction. This action will stretch the apparatus 200 so that it can be snugly placed on the shoe 300. The stretching of apparatus 200 will cause the opening 214 to be elongated in the direction of the length of the shoe 300 as shown by comparing opening 214 in an at rest or non stretched state as in FIG. 7 with opening 214 in a stretched state as in FIG. 11. The opening 220 is also elongated from an at rest state as in FIG. 7 to a stretched state as in FIG. 11. In addition, as shown in FIG. 9, the tab 228 is pulled above a toe portion 308 of the sole of the shoe 300. Also, as shown in FIG. 10, the portion 225 of the apparatus 200 and the tabs 222, 224, and 226 are pulled above a heel portion 306 of the sole of the shoe 300. In the state of FIGS. 8-11, the peripheral ridge 260, in at least one embodiment, substantially surrounds the majority of the outer perimeter 301*a* of the sole 301 of the shoe.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a retaining device; and a plurality of flexible spike devices, which have memory of form so that each of the plurality of flexible spike devices is adapted to be flexed by a flexing force to change from a rest state into a deformed state, and when the flexing force is removed, each of the plurality of flexible spike devices returns to a rest state;

wherein the retaining device is adapted to be temporarily attached to a shoe;

wherein the retaining device is adapted so that the plurality of spike devices is adapted to be attached or detached from the retaining device, while the retaining device is temporarily attached to the shoe;

wherein the retaining device has a toe end and a heel end;

wherein the retaining device has a plurality of first chambers and second chambers;

wherein each of the plurality of first chambers leads to a corresponding one of the plurality of second chambers;

wherein each of the plurality of first chambers is substantially smaller than each of the plurality of second chambers;

wherein the retaining device is adapted to be temporarily attached to the shoe so that each of the plurality of second chambers lies between the shoe and one of the plurality of first chambers;

wherein each of the plurality of flexible spike devices includes a top portion, a middle portion, and a base portion;

wherein in a non compressed state, each of the top portions of each of the flexible spike devices has an area substantially larger than each of the plurality of first chambers;

wherein in a compressed state, each of the top portions of each of the flexible spike devices has an area which is less than or equal to each of the plurality of first chambers so that each of the top portions is adapted to be inserted into and through each of the plurality of first chambers;

wherein each of the flexible spike devices is adapted to be inserted into the retaining device so that each of the top portions sits within one of the plurality of second chambers while simultaneously each of the middle portions sits within one of the plurality of first chambers;

wherein the retaining device comes in contact with a sole of the shoe at a plurality of regions, each of the plurality of regions immediately adjacent one of the plurality of second chambers, when the retaining device is temporarily attached to the shoe without any of the flexible spike devices being inserted into the retaining device; and wherein the retaining device comes in contact with the sole of the shoe at the plurality of regions, when the retaining device is temporarily attached to the shoe, and with the flexible spike devices inserted into the retaining device, so that each of the top portions sits within one of the plurality of second chambers while simultaneously each of the middle portions sits within one of the plurality of first chambers.

2. The apparatus of claim 1 wherein the retaining device is made of an elastomeric material.

3. An apparatus comprising a retaining device; and a plurality of flexible spike devices, which have memory of form so that each of the plurality of flexible spike devices is adapted to be flexed by a flexing force to change from a rest state into a deformed state, and when the flexing force is removed, each of the plurality of flexible spike devices returns to a rest state;

wherein the retaining device is adapted to be temporarily attached to a shoe;

wherein the retaining device is adapted so that the plurality of spike devices is adapted to be attached or detached from the retaining device, while the retaining device is temporarily attached to the shoe;

wherein the retaining device has a toe end and a heel end;

wherein the retaining device has a periphery which surrounds and contacts the shoe when the retaining device is temporarily attached to the shoe;

wherein the periphery has a thickness;

wherein the retaining device has a first pull tab located at the toe end of the retaining device;

wherein the first pull tab projects out from the periphery a first distance which is greater than the thickness of the periphery;

wherein the retaining device has a second pull tab located at the heel end of the retaining device; and wherein the second pull tab projects out from the periphery a second distance which is greater than the thickness of the periphery.

4. The apparatus of claim 1 wherein each of the plurality of spike devices has a flat side which is adapted to be fully inserted into each of the plurality of first chambers of the retaining device in order to attach each of the plurality of spike devices to the retaining device.

5. The apparatus of claim 4 wherein each of the plurality of spike devices has a plurality of protrusions which project out away from the flat side.

6. The apparatus of claim 1 wherein each of the plurality of spike devices is made of an elastomer.

7. The apparatus of claim 1 wherein the retaining device includes an extension at the heel end having an opening for insertion of a ball marker or tee.

8. The apparatus of claim 1 wherein the retaining device is adapted to retain five spike devices in a pattern wherein four of the five spike devices substantially define a square and the fifth spike device is substantially at the center of the square in a toe portion of the retaining device; and wherein the retaining device is adapted to retain two spike devices in a heel portion of the retaining device.

9. A method comprising:

attaching a retaining device to a shoe;

attaching a plurality of spike devices to the retaining device;

detaching the retaining device from the shoe; and wherein the retaining device is adapted so that the plurality of spike devices is adapted to be attached or detached from the retaining device, while the retaining device is temporarily attached to the shoe;

wherein the retaining device has a toe end and a heel end;

wherein the retaining device has a plurality of first chambers and second chambers;

wherein each of the plurality of first chambers leads to a corresponding one of the plurality of second chambers;

wherein each of the plurality of first chambers is substantially smaller than each of the plurality of second chambers;

wherein the retaining device is adapted to be temporarily attached to the shoe so that each of the plurality of second chambers lies between the shoe and one of the plurality of first chambers;

wherein each of the plurality of flexible spike devices includes a top portion, a middle portion, and a base portion;

wherein in a non compressed state, each of the top portions of each of the flexible spike devices has an area substantially larger than each of the plurality of first chambers;

wherein in a compressed state, each of the top portions of each of the flexible spike devices has an area which is less than or equal to each of the plurality of first chambers so that each of the top portions is adapted to be inserted into and through each of the plurality of first chambers;

wherein each of the flexible spike devices is adapted to be inserted into the retaining device so that each of the top portions sits within one of the plurality of second chambers while simultaneously each of the middle portions sits within one of the plurality of first chambers;

wherein the retaining device comes in contact with a sole of the shoe at a plurality of regions, each of the plurality of regions immediately adjacent one of the plurality of second chambers, when the retaining device is temporarily attached to the shoe without any of the flexible spike devices being inserted into the retaining device; and wherein the retaining device comes in contact with the sole of the shoe at the plurality of regions, when the retaining device is temporarily attached to the shoe, and with the flexible spike devices inserted into the retaining device, so that each of the top portions sits within one of the plurality of second chambers while simultaneously each of the middle portions sits within one of the plurality of first chambers.

10. The method of claim 9 wherein the retaining device is made of an elastomeric material.

11. A method comprising attaching a retaining device to a shoe;

attaching a plurality of spike devices to the retaining device;

detaching the retaining device from the shoe; and wherein the retaining device is adapted so that the plurality of spike devices is adapted to be attached or detached from the retaining device, while the retaining device is temporarily attached to the shoe;

wherein the retaining device has a toe end and a heel end;

wherein the retaining device has a periphery which surrounds and contacts the shoe when the retaining device is temporarily attached to the shoe;

wherein the periphery has a thickness;

wherein the retaining device has a first pull tab located at the toe end of the retaining device;

wherein the first pull tab projects out from the periphery a first distance which is greater than the thickness of the periphery;

wherein the retaining device has a second pull tab located at the heel end of the retaining device; and wherein the second pull tab projects out from the periphery a second distance which is greater than the thickness of the periphery.

12. The method of claim 9 wherein each of the plurality of spike devices has a flat side which is adapted to be fully inserted into each of the plurality of first chambers of the retaining device in order to attach each of the plurality of spike devices to the retaining device.

13. The method of claim 12 wherein each of the plurality of spike devices has a plurality of protrusions which project out away from the flat side.

14. The method of claim 9 wherein each of the plurality of spike devices is made of an elastomer.

15. The method of claim 9 wherein the retaining device includes an extension at the heel end having an opening for insertion of a ball marker or tee.

16. The method of claim 9 wherein the retaining device is adapted to retain five spike devices in a pattern wherein four of the five spike devices substantially define a square and the fifth spike device is substantially at the center of the square in a toe portion of the retaining device; and wherein the retaining device is adapted to retain two spike devices in a heel portion of the retaining device.

17. The method of claim 9 further comprising playing golf with the retaining device attached to the shoe and with the plurality of spike devices attached to the retaining device.

18. The method of claim 11 wherein the second pull tab has an opening configured such that a pointed end of an object is adapted to be inserted into the opening to cause the second pull tab to surround the object, to thereby retain the object to the retaining device; and further comprising inserting a pointed end of a ball marker into the opening to thereby retain the ball marker to the retaining device.

19. The method of claim 11 wherein the second pull tab has an opening configured such that a pointed end of an object is adapted to be inserted into the opening to cause the second pull tab to surround the object, to thereby retain the object to the retaining device; and further comprising inserting a pointed end of a tee into the opening to thereby retain the tee to the retaining device.

20. The apparatus of claim 3 wherein the second pull tab has an opening configured such that a pointed end of an object is adapted to be inserted into the opening to cause the second pull tab to surround the object, to thereby retain the object to the retaining device.

* * * * *